United States Patent [19]

Riedl

[11] 4,095,363

[45] Jun. 20, 1978

[54] FALLING BREECH BLOCK ACTION FOR A SINGLE SHOT ACTION

[76] Inventor: James Loren Riedl, 15124 Weststate, Westminster, Calif. 92683

[21] Appl. No.: 701,543

[22] Filed: Jul. 26, 1976

[51] Int. Cl.[2] ..... F41C 11/04

[52] U.S. Cl. ..... 42/23; 42/75 A

[58] Field of Search ..... 42/23, 24, 70 E, 75 A, 42/75 C

[56] References Cited

U.S. PATENT DOCUMENTS

| | | | |
|---|---|---|---|
| 38,455 | 5/1863 | Aldrich | 42/23 |
| 1,632,892 | 6/1927 | Glans et al. | 42/23 |
| 3,621,596 | 11/1971 | Colliander et al. | 42/23 |
| 3,733,729 | 5/1973 | Baker | 42/23 |
| 3,735,517 | 5/1973 | DeHaas et al. | 42/23 |
| 3,830,000 | 8/1974 | Browning | 42/23 |
| 3,863,375 | 2/1975 | Browning | 42/75 C |
| 4,002,101 | 1/1977 | Tellie | 42/70 E |

*Primary Examiner*—Charles T. Jordan

[57] ABSTRACT

A spur-less hammer type breech block action for a breech loading single shot firearm which has a breech block within a vertical mortise in the receiver which is lowered by a finger lever pivoting on a pin.

2 Claims, 12 Drawing Figures

A

FRONT

B

REAR

FALLING BREECH BLOCK ACTION FOR A SINGLE SHOT ACTION

BACKGROUND OF THE INVENTION

This invention relates to a hammer-type falling block single shot action for a firearm and particularly to the breeching, firing, and extraction mechanisms of this action.

All the falling block actions presently in production have a toggle-link system that locks the breech block in the firing position, and lowers the breech block after firing. Such a toggle-link system is difficult to manufacture and assemble. Also, due to these pins, links, and joints, the breeching system will always have mechanical "play" which is not conductive to tight breeching.

The device which safes the trigger on previously manufactured single shot actions has always been located on the hammer half-cock, thumb slide on top of receiver, or on the transverse button on the rear of the trigger guard. Each location is not optimum in regard to removing the safety fast and protecting the safety from being accidentally pushed on. Also, previous single shot actions were designed for right-handed safety operation not providing comfortable operation for a left-handed shooter. Previously produced single shot actions have device for ejecting the cartridge or case from the barrel. Either the device was an extractor, or an ejector. These actions usually have an adjustment which allows extraction or ejection but never both simultaneously. Previous single shot actions were susceptible to firing pin or hammer damage when dry-fired without a cartridge primer to soften the forces on the pin and hammer.

Previous single shot actions contain many pinned and screwed in parts which caused dis-assembly and assembly of the action to be difficult and in many cases expert knowledge was required to dis-assemble the action for cleaning or parts removal or inspection.

BRIEF DESCRIPTION OF THE INVENTION

This invention consists of a receiver into which a barrel is threaded; an inclined square hole in which the breech block moves; a rack toothed breech block containing a hammer and torsion spring, firing pin and spring, and firing pin bushing; a small housing containing trigger, sear, and safety which is fitted in a slot cut into the receiver and held in by a split screw hole; a finger lever with pinion teeth pivoting on a pin; an ejector/extractor held under tension by a helix spring and screw; a spring-loaded ball plunger which holds the finger lever locked up during firing located at the rear of the receiver; the receiver has a theaded hole above the finger lever plunger hole at the rear of the receiver which accepts a thru-bolt for holding on the buttstock. A slot underneath the threaded hole for the barrel accepts a forearm-hanger which supports the forearm free of contact with the barrel.

For ejection or extraction of a cartridge a pin-pivoted extractor inside the receiver is spring loaded such as to snap in behind the case rim when the breech block is raised. When the breech block is lowered by use of the finger lever, the breech block contacts the extractor, causing it to pivot and extract the cartridge, then a cam-point on the breech block contacts the extractor rapidly ejecting the cartridge mechanically. The extractor will handle rimmed, rimless, rebated rim, and belted cartridges.

This invention provides a lateral-moving safety button directly in front of the trigger. The safety is locked into safe or fire positions by means of a spring loaded ball. The safety, trigger, and gear are all pinned into a single trigger housing which is held into the receiver by a split threaded hole, thus this assembly of parts is called the trigger housing. The trigger has adjustments for trigger pull and trigger creep. The safety has an adjustment which is set after the trigger has been set. The safety can also be made right or left handed by internal adjustments.

This invention has a square breech block which moves vertically when the finger is unlatched from its ball-plunger detent. The breech bock has a toothed rack on the front side which contacts the semi circular toothed pinion on the finger lever. A safe, strong and positive vertical motion and locking of the breech block is thus achieved. Futhermore, the hammer, hammer spring, firing pin and spring and firing pin bushing are all attached to breech block which constitutes one compact assembly. The spring loaded firing pin retracts after the hammer strikes, sealing the firing pin against the back hole in the breech block preventing gas blow back in the event a cartridge primer ruptures.

The hammer has a lip which slips into a sear housed in the trigger housing. A desirable feature of the hammer-sear arrangement is that when the breech block is lowered to its lowest position, the hammer-sear contact protrudes the firing pin out of the firing pin bushing to its fullest extent, then when the finger lever is released, the spring loaded firing pin retracts, forcing the hammer back bringing the breech block up into exact alignment such that the cartridge to be loaded is pushed into the chamber across the top of the breech block which thus acts as a guide. The purpose of having the firing pin protrude and retract is to clear the firing pin hole in the firing pin bushing. In the event corrosion occurred the firing pin could otherwise be protruded, frozen by corrosion. This feature safely prevents malfunction of the firing pin as it is cleared each time the breech bock is lowered. To further enhance the firing pin retraction, a sloping groove is cut into the receiver directly in front of the breech block such that an inclined surface results which also forces the firing pin to retract.

This brief description of the invention shows a single shot action that is safe, easy to disassemble, and easy to manufacture by use of investment casting (this has been proven as the action is presently in production). The objectives of the invention are: provide safe locking of the breech block via a rack on the breech block and a pinion on the finger lever, safe self cleaning of the firing pin via protrude and retract features, a safe fast operating right or left handed safety protected from inadvertent operation by the finger lever, an extract and/or eject feature for cartridge extraction, compact modular assemblies consisting of trigger housing and breech block which are removed from the receiver by removing only two screws, provision for a free floating barrel forearm hanger mounted in a slot underneath the barrel, and the overall invention is especially designed such that economical investment casting of the action parts is possible.

The invention will now be described in full with use of the illustrations. Additional features of the invention will also become apparent.

FIGURES

DETAILED DESCRIPTION OF THE PREFERRED EMBODIMENTS OF THE INVENTION

Figure 1:
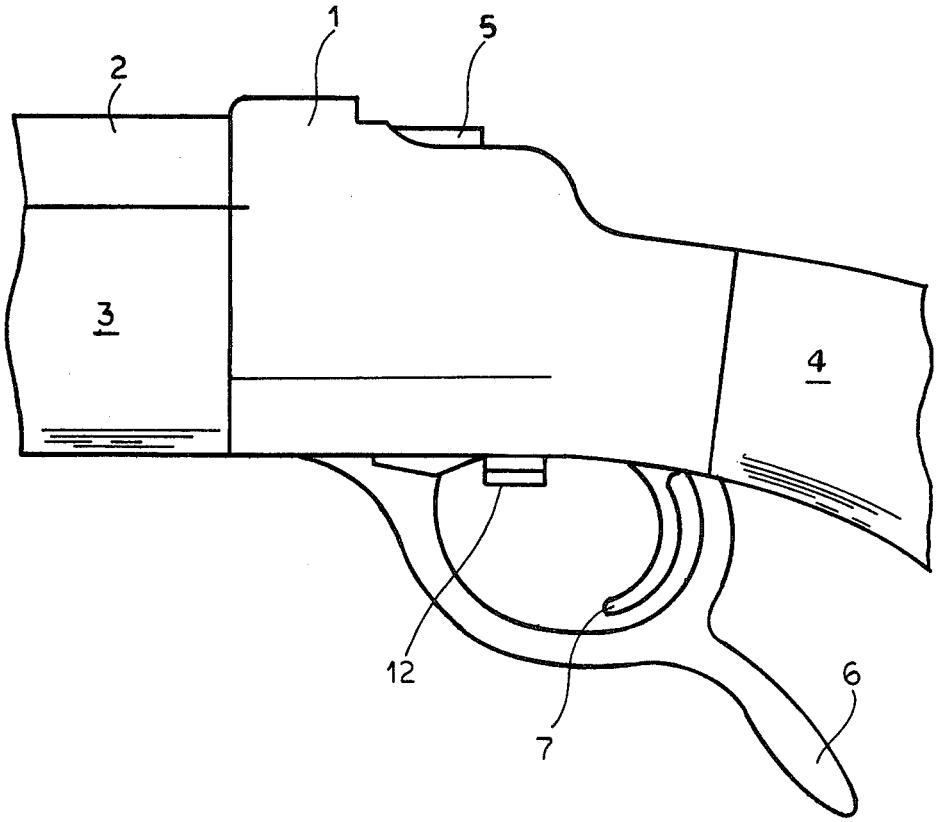
FIG. 1 is a left-hand outside view of the invention showing the major large parts, and associated stocking.
Figure 2:
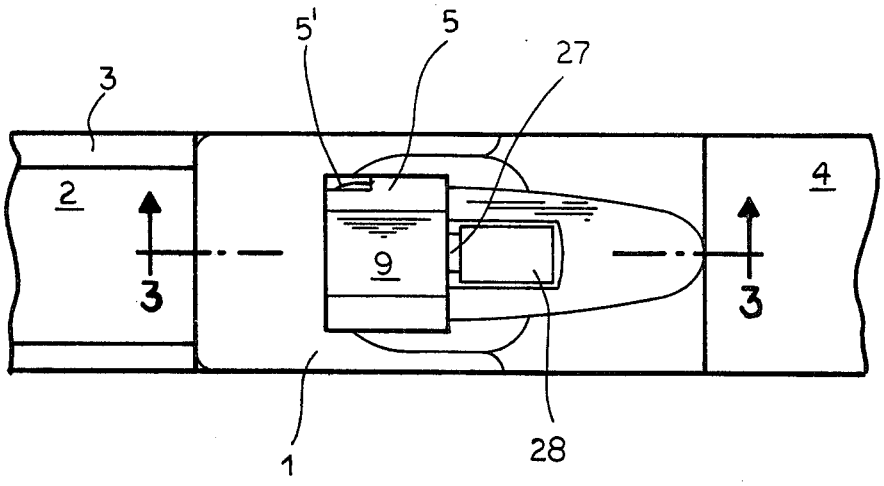
FIG. 2 is a top outside view of the invention with detail visible therein.
Figure 3:
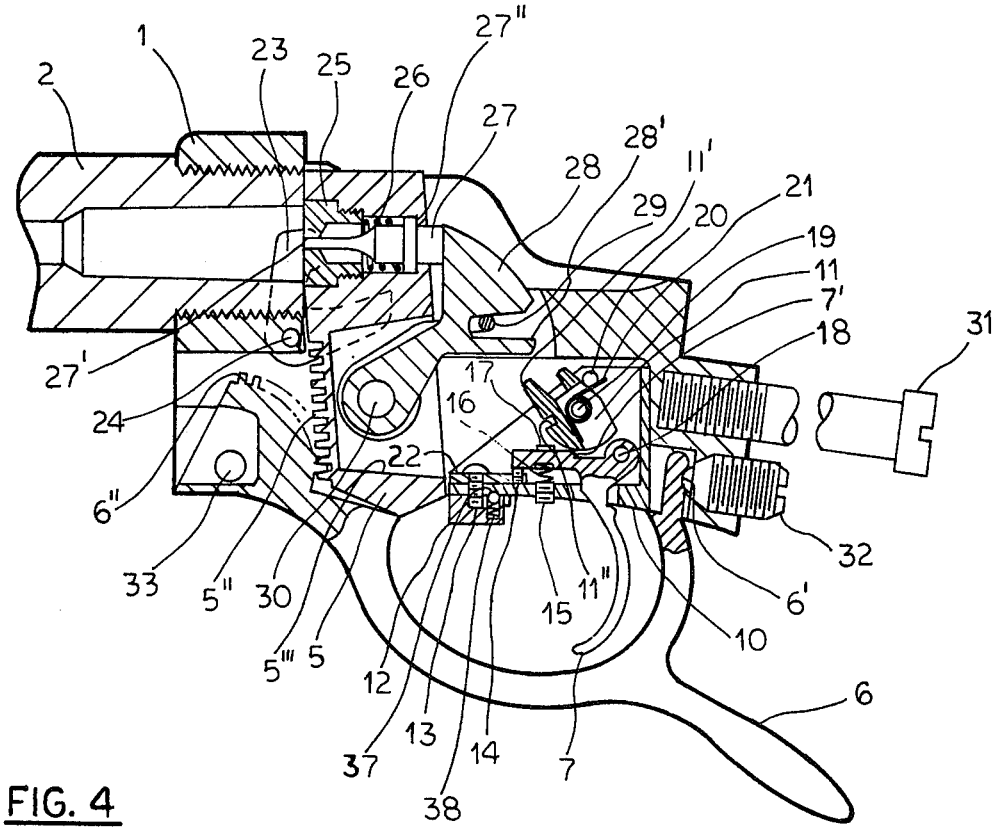
FIG. 3 is a cut-away view of the closed action showing most internal parts and their positions in a closed view.
Figure 4:
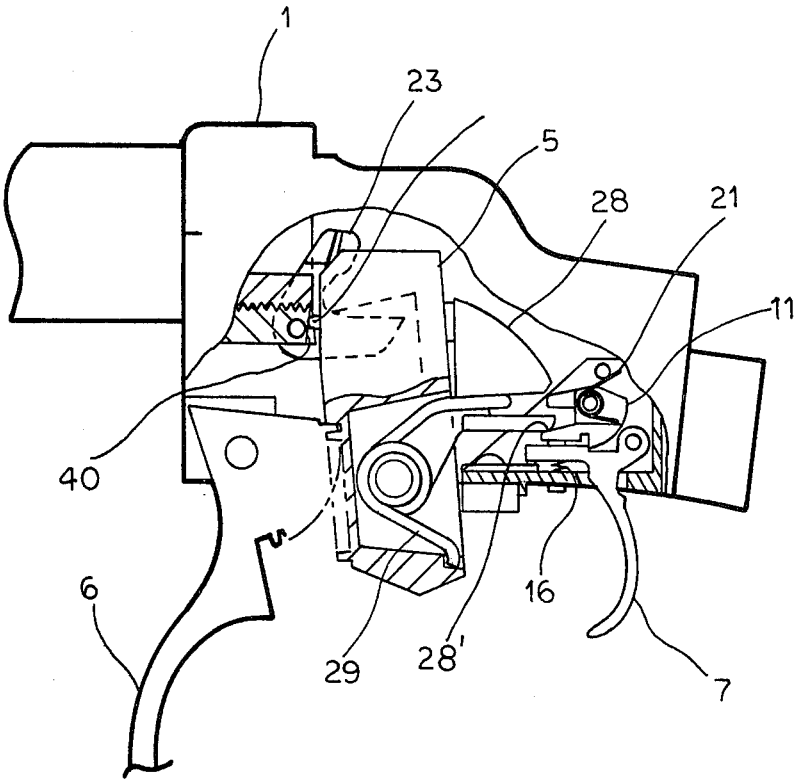
FIG. 4 is a cut-away view of the open action showing the engagement of the sear, trigger, hammer and extractor, and firing pin retractor.
Figure 5:
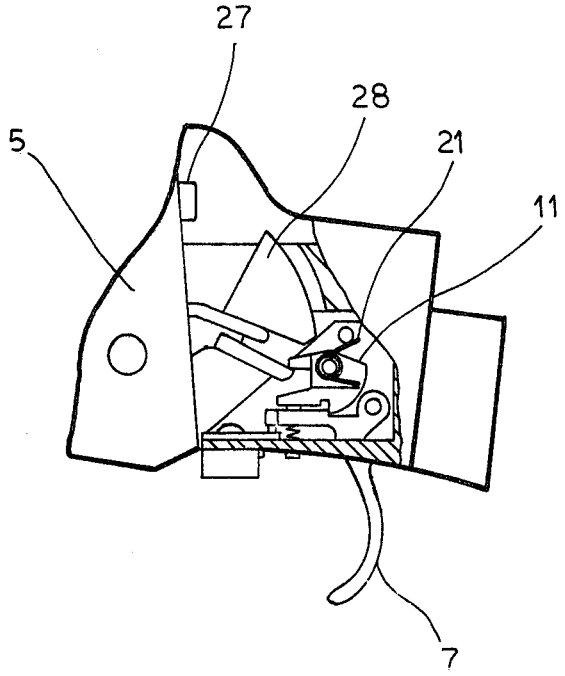
FIG. 5 is a cut-away view detailing the hammer cocked view of the action.
Figure 6:
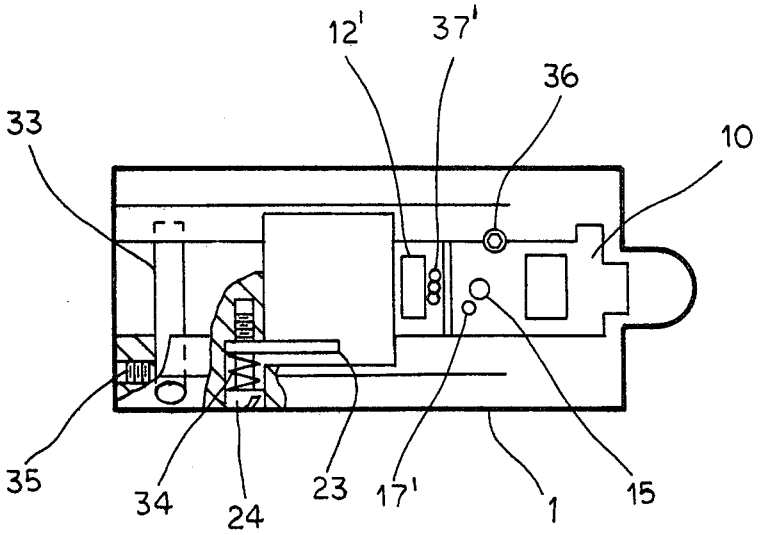
FIG. 6 is a bottom view of the invention showing additional pin, screw, and adjustment holes and housing not visible in the above FIGS. 1–5.
Figure 7:
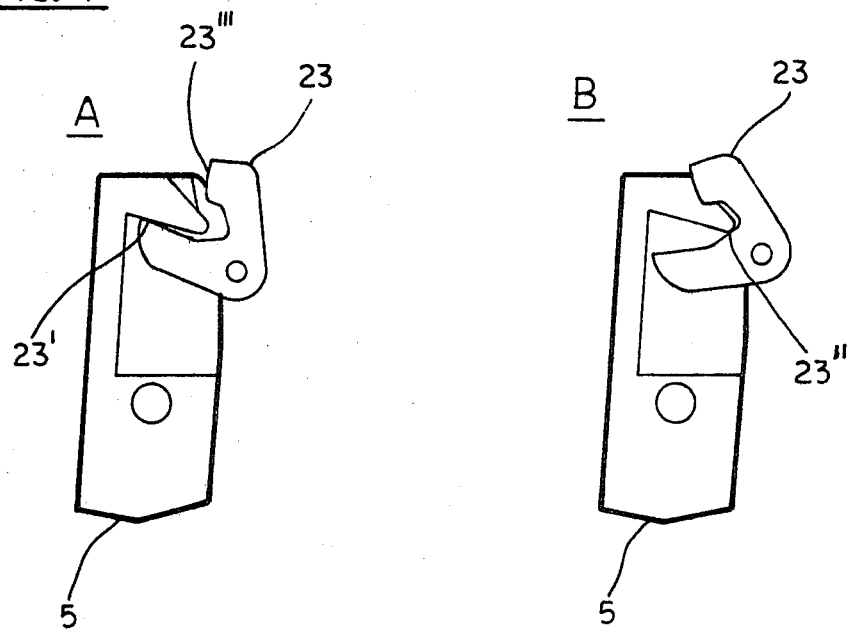
FIGS. 7A and 7B are two views of the breech block and extractor illustrating the extract and eject feature.

The single shot action illustrated consists of a receiver 1 to which a barrel 2 and butt stock 4 are attached (see FIGS. 1 & 2) The forearm 3 is attached to the barrel. The buttstock is held to the action by a thru-bolt 31 (FIG. 3). The action also contains a breech block 5 which moves up and down in a square hole 9 inside the receiver. The square hole is set at a 4.5° angle with respect to the barrel bore. The action also contains a finger lever 6 which pivots on a pin 33. The finger lever has pinion teeth which mate to rack teeth on the front of the breech block. When the finger is swung down, the pinion teeth, in contact with the breech block rack teeth, causes the breech block to lower (see FIGS. 3 & 4). With the breech block 5 lowered, the cartridge can be inserted over the top into the barrel. The finger lever pin 33 is held into the receiver by a screw 35 (FIG. 6). The action contains a trigger housing 10 which is held into a slot in the bottom (FIG. 6) of the receiver. The the housing is held by a screw 36 screwed into a split threaded hole; half a hole in the receiver and half a hole in the housing. The action contains an extractor/ejector 23 held in the receiver by a screw 24 (FIGS. 4 & 6) and held under tension by a coiled spring 34. A slot on the side of the breech block (see FIG. 7) allows the breech block to move freely up and down in the receiver without contacting the extractor/ejector until cartridge extraction is desired. When cartridge extraction is desired, the finger lever is forced down (see FIG. 4) the leg of the extractor/ejector 23 (FIG. 7) contacts the breech block at point 23', forcing the extractor/ejector to pivot backwards around the extractor/ejector screw 24. Pivoting backwards the extractor/ejector extracts the cartridge from the barrel. If the finger lever is forced down to a lower position, the extractor/ejector contacts the breech block at point 23'' which, due to the shortened mechanical-lever, ejects the cartridge rapidly from the barrel. When the finger lever is at this position the extractor/ejector lip 23''' contacts the breech block at point 5' (FIG. 2) which forces the extractor/ejector 23 slightly sideways away from the cartridge rim allowing the cartridge to eject easily from the action. Pulling the finger lever up moves the breech block up. The finger lever is held locked up against the action by a spring loaded ball-plunger 32 screwed into the receiver (FIG. 3). If the trigger 7 is held back when the finger lever is closed, the hammer remains uncocked as shown in FIG. 3. Otherwise, closing the finger lever cocks the hammer as shown in FIG. 5. When the action is being closed (breech block going up) the extractor/ejector is pushed forward by the front of the breech block. The extractor/ejector being spring-loaded snaps over and behind the rim of a cartridge in the barrel.

The trigger housing 10 (see FIGS. 3, 4 and 5) contains a sear 11, pin 19, and spring 21; a trigger 7, pin 18, and trigger let off adjustment screw 17; an external safety 12, screw 13, safety bar 22, safety adjust screw 14, safety detent ball 37, and spring 38; a trigger pull adjust screw 15 and spring 16; a sear stop-pin 20.

Figure 9:
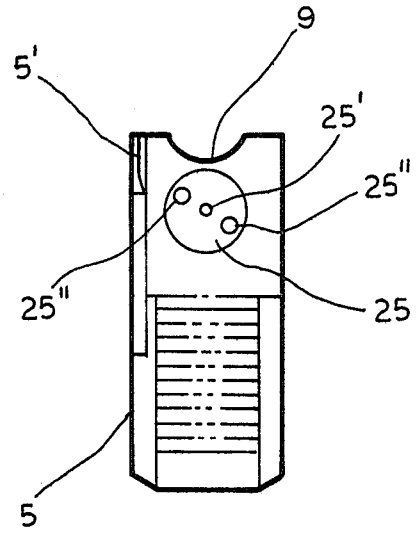
FIGS. 9A and 9B are front and rear views of the breech block. Hammer not shown for clarity.
Figure 9:
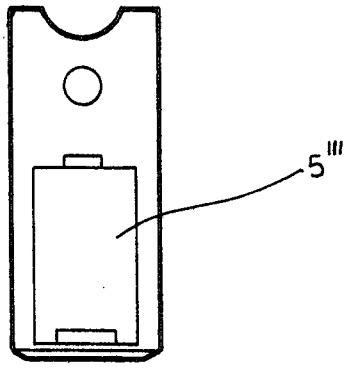

The breech block (see FIGS. 3 & 5) contains a firing pin 27 and firing pin return spring 26, a firing pin hold-in bushing 25, a hammer 28, hammer spring 29, and hammer pin 30. The firing pin bushing 25 is screwed into the front of the breech block using holes 25'' (FIG. 9).

OPERATION OF THE INVENTION

With the action in a fired closed condition, the action parts are in the position shown in FIG. 3. With the action open and cartridge ejected the action parts appear as in FIG. 4. When the action is closed and cocked, the action parts appear as shown in FIG. 5, with the finger lever locked up as shown in FIG. 3.

With action in the uncocked fired condition shown in FIG. 3, it is ready for loading. The operator lowers the finger lever 6 simultaneously forcing the finger lever detent hole 6' to push back the ball in the spring loaded ball plunger 32 allowing the finger lever to lower. As the finger lever is lowered its pinion teeth 6'' in contact with the breech block rack teeth 5'' cause the breech block 5 to slide down the receiver mortise hole 9. The finger lever is pivoted on finger lever pin 33. As the finger lever is lowered further, the downward moving breech block forces the hammer leg 28' to contact the sear leg 11'; subsequent lowering of the finger lever pivots the sear 11 around pin 19 forcing the sear lip 11'' to slip over the trigger lip 7'. The trigger 7 snaps up behind the sear lip under tension from trigger spring 16 and trigger adjust screw 15. The trigger is pivoted on trigger pin 18.

Figure 8:
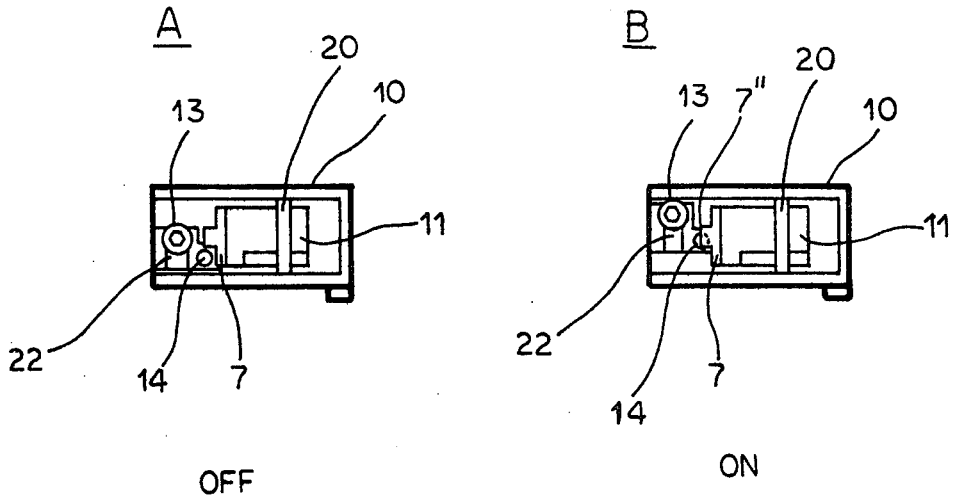
FIGS. 8A and 8B are two views of the trigger housing, safety, sear and associated holding pins and adjustment screws.

While the hammer leg 28' is contacting the sear leg, the extractor/ejector 23 (FIG. 7) is pivoting on screw 24 due to the breech block contact at point 23' and starting to extract the cartridge in the barrel 2. Subsequently while the finger lever is moving toward its lowest point, the action is cocked as shown in FIG. 4 while simultaneously the extractor has pivoted back to its farthest position by contact with the breech block at point 23'' and simultaneously moved slightly sideways due to the contact of the extractor/ejector lip 23''' with the breech block, also at this time the sear leg in contact with the hammer leg (see FIG. 4) has forced the hammer to push the firing pin 27 forward causing the firing pin tip 27' to protrude out of the firing pin bushing 25. This action clears the firing pin bushing hole 25' (FIG. 9A) to be cleared or cleaned of corrosion. At this point firing pin return spring 26 is compressed, along with trigger spring 16. Now, when the operator releases the finger lever, the compression of the firing pin spring forces the hammer back such that the firing pin tip 27' is pushed back unprotruded and flush with the firing pin bushing 25. A slight taper 40 cut into the receiver (FIG. 4) additionally causes the firing pin to be forced back flush with the firing pin bushing. A shoulder on the firing pin 27'' (see FIG. 3) contacts a similar shoulder in the breech block firing pin hole sealing possible blow back of escaping gas from a ruptured cartridge primer. With the action in the cocked condition as shown in FIG. 4, a cartridge is inserted into the barrel and the finger lever back toward its closed position. When pulling back to its closed position, the breech block moves up in the receiver mortise pushing the pivoting extractor/ejector back toward the cartridge rim while simultaneously the hammer 28 is being pivoted on pin 30 tensioning the coiled hammer spring 29 while simultaneously the sear lip and trigger lip remain engaged (FIG. 4). Upon pivoting the finger lever up and locking it up against the ball plunger 32 the hammer is fully cocked and ready for firing as shown in FIG. 5. The trigger can now be pulled, pivoting it around trigger pin 18 and releasing sear 11. The action is now once more in the fired condition of FIG. 3. A sear spring 21 holds the sear up so that it may contact the hammer during cocking (FIG. 3). The distance the trigger must be pulled to release the sear is adjusted by trigger let off adjust screw 17. The amount of trigger pull needed to release the sear is adjusted by trigger spring 16 and trigger adjust screw 15. To prevent the sear from pivoting completely over, a sear stop-pin 20 stops the sear from pivoting on its pivot pin 19 as shown in FIG. 3. While the action is cocked, the safety 12 may be engaged (see FIG. 1, 3, 6, 8). The safety moves laterally in a slot 12' cut into the trigger housing 10 (see FIG. 6). With the safety in the off position (FIG. 8A) the trigger can be pulled. With the safety on, (FIG. 8B) a safety bar 22 (screwed to the safety) slides laterally underneath the trigger tip 7''. A safety adjust screw 14 (see FIGS. 3 & 8) is adjusted to just fit underneath the trigger tip. The safety is held on or off by a safety ball 12 and safety detent ball spring 38. Three even spaced detent holes 37' (see FIG. 6) are used to hold the safety in tne on or off positions. The center hole of 37' is the off detent hole. Either side hole 37' is the on detent hole. The safety detent ball under tension from its detent coiled spring snaps into either hole when the safety is moved laterally. Note that the ball and spring are contained in a hole drilled into the safety (see FIG. 3). The safety bar 22 (FIG. 8) is held onto the safety 12 by screw 13. The positions shown in FIG. 8 are for right handed operator. By removing screw 13 and turning safety bar 22 over and re-screwing, the safety is now ready for a left handed operator. The action will not cock or eject a cartridge with the safety on unless the sear and trigger have engaged as shown on FIG. 4. Disassembly of the action is rapid and easy (FIG. 6). Removal of trigger housing screw 36 allows the trigger housing to drop free of the receiver as an assembly. Removal of extractor/ejector screw 24 and spring 34 allows the breech block assembly and extractor/ejector to drop free of the action. Removal of screw 35 allows the finger lever pivot pin 33 and the finger lever to drop free of the receiver. The action and assemblies are now open and clear for inspection and cleaning.

The preferred embodiments of the invention have herein been illustrated. It will be understood that minor modifications can be made to the action parts without departing from the basic invention.

I claim:

1. An improvement in a falling block single shot action for a firearm comprising a receiver, a rack toothed breech block in the receiver vertically movable by a pinion toothed finger lever pivotable on a pin, the breech block containing firing pin and self-cocking hammer parts removable from the receiver as an assembly; the finger lever being held closed by a ball plunger positioned to provide maximum closed holding power; a trigger housing assembly comprising a trigger, safety, and sear contained in a trigger housing; the safety and trigger being fully adjustable; and the complete trigger housing assembly being removably mounted in the receiver by a screw threaded into a threaded hole; the threaded hole being longitudinally split with half of the hole in the receiver and half of the hole in the trigger housing.

2. An improvement in a falling block single shot action according to claim 1, wherein said firearm has a cocking action based upon sear-hammer engagement to reduce wear and pressure on the sear and trigger.

* * * * *